US009803379B2

(12) United States Patent
Randjelovic

(10) Patent No.: US 9,803,379 B2
(45) Date of Patent: Oct. 31, 2017

(54) VIBRATION DAMPING FLOOR SYSTEM

(71) Applicant: Connor Sports Flooring, LLC, Salt Lake City, UT (US)

(72) Inventor: Erlin A. Randjelovic, Crystal Falls, MI (US)

(73) Assignee: Connor Sports Flooring, LLC, Salt Lake City, UT (US)

( * ) Notice: Subject to any disclaimer, the term of this patent is extended or adjusted under 35 U.S.C. 154(b) by 0 days.

(21) Appl. No.: 15/146,607

(22) Filed: May 4, 2016

(65) Prior Publication Data

US 2017/0114552 A1 Apr. 27, 2017

Related U.S. Application Data

(60) Provisional application No. 62/156,685, filed on May 4, 2015.

(51) Int. Cl.

| | |
|---|---|
| ***E04F 15/022*** | (2006.01) |
| ***E04F 15/22*** | (2006.01) |
| ***E04F 15/02*** | (2006.01) |
| ***E04B 5/12*** | (2006.01) |
| ***E04B 5/43*** | (2006.01) |

(52) U.S. Cl.

CPC ..... *E04F 15/225* (2013.01); *E04B 5/12* (2013.01); *E04B 5/43* (2013.01); *E04F 15/02194* (2013.01)

(58) Field of Classification Search

CPC .... E04F 15/225; E04F 15/22; E04F 15/02194
USPC ..... 52/403.1, 480
See application file for complete search history.

(56) References Cited

U.S. PATENT DOCUMENTS

| | | | |
|---|---|---|---|
| 498,344 | A | 5/1893 | Williams |
| 802,622 | A | 10/1905 | Van Den Bulcke |
| 1,195,289 | A | 8/1916 | Stevens |
| 1,302,578 | A | 5/1919 | Murphy |
| 1,339,425 | A | 5/1920 | Stevens |
| 1,342,610 | A | 6/1920 | Wheeler |
| 1,343,234 | A | 6/1920 | Stevens |

(Continued)

FOREIGN PATENT DOCUMENTS

| | | | |
|---|---|---|---|
| CN | 2581609 | Y | 10/2003 |
| CN | 2587981 | Y | 11/2003 |

(Continued)

*Primary Examiner* — Christine T Cajilig
(74) *Attorney, Agent, or Firm* — Thorpe North & Western LLP

(57) ABSTRACT

A floor is disclosed having an upper contact surface disposed atop an upper subfloor, the upper subfloor having a void with a height that is defined by opposing sidewalls of the first subfloor, a top that is defined by a bottom surface of the upper contact surface, a bottom that is defined by a top surface of a lower subfloor, a width, and a length. A first resilient pad is disposed under compression within the void of the upper subfloor. The lower subfloor is disposed beneath and in contact with the upper subfloor. The lower subfloor has a void that is laterally offset from the void of the upper subfloor and a second resilient pad disposed within the void. A plurality of removable force transfer members are disposed within the void of the lower subfloor and above the second resilient pad for transferring vibrational forces and downward vertical forces to the second resilient pad.

33 Claims, 7 Drawing Sheets

(56) References Cited

U.S. PATENT DOCUMENTS

| | | | |
|---|---|---|---|
| 1,350,349 | A | 8/1920 | Walther |
| 1,491,198 | A | 4/1924 | Cassidy |
| 1,587,355 | A | 6/1926 | Raun |
| 1,668,842 | A | 5/1928 | Dudfield et al. |
| 1,692,855 | A | 11/1928 | Murphy |
| 1,693,655 | A | 12/1928 | Murphy |
| 1,752,583 | A | 4/1930 | Wright |
| 1,781,117 | A | 11/1930 | Mackie et al. |
| 1,787,067 | A | 12/1930 | Eisler |
| 1,911,433 | A | 5/1933 | Cinnamond |
| 1,977,496 | A | 10/1934 | Snyder et al. |
| 2,066,005 | A | 12/1936 | Jenkins |
| 2,092,694 | A | 7/1937 | Crooks |
| 2,134,674 | A | 10/1938 | Sherman et al. |
| 2,167,836 | A | 8/1939 | Greulich |
| 2,414,986 | A | 1/1947 | Tinnerman |
| 2,708,781 | A | 5/1955 | McMullan |
| 2,742,121 | A | 4/1956 | Liskey, Jr. |
| 2,862,255 | A | 12/1958 | Nelson |
| 2,996,160 | A | 8/1961 | Voight |
| 3,045,294 | A | 7/1962 | Livezey, Jr. |
| 3,080,021 | A | 3/1963 | Muir |
| 3,114,940 | A | 12/1963 | Rockbrand et al. |
| 3,271,916 | A | 9/1966 | Omholt |
| 3,387,422 | A | 6/1968 | Wanzer |
| 3,398,491 | A | 8/1968 | Babcock |
| 3,518,800 | A | 7/1970 | Tank |
| 3,562,990 | A | 2/1971 | Boettcher |
| 3,566,569 | A | 3/1971 | Coke et al. |
| 3,596,422 | A | 8/1971 | Boettcher |
| 3,786,608 | A | 1/1974 | Boettcher |
| 3,788,021 | A | 1/1974 | Husler |
| 3,868,802 | A | 3/1975 | Schubach |
| 3,909,059 | A | 9/1975 | Benninger et al. |
| 4,170,859 | A | 10/1979 | Counihan |
| 4,481,747 | A | 11/1984 | Tengesdale et al. |
| 4,599,842 | A | 7/1986 | Counihan |
| 4,819,932 | A | 4/1989 | Trotter, Jr. |
| 4,831,806 | A | 5/1989 | Niese |
| 4,856,250 | A | 8/1989 | Gronau et al. |
| 4,879,856 | A | 11/1989 | Jones et al. |
| 4,879,857 | A | 11/1989 | Peterson et al. |
| 4,890,434 | A | 1/1990 | Niese |
| 4,930,280 | A | 6/1990 | Abendroth |
| 5,016,413 | A | 5/1991 | Counihan |
| 5,253,464 | A | 10/1993 | Nilsen |
| 5,365,710 | A | 11/1994 | Randjelovic |
| 5,369,710 | A | 11/1994 | Asai |
| 5,369,927 | A | 12/1994 | Counihan |
| 5,377,471 | A | 1/1995 | Niese |
| 5,388,380 | A | 2/1995 | Niese |
| 5,475,959 | A | 12/1995 | Mackenzie |
| 5,497,590 | A | 3/1996 | Counihan |
| 5,609,000 | A | 3/1997 | Niese |
| 5,647,183 | A | 7/1997 | Counihan |
| 5,778,621 | A | 7/1998 | Randjelovic |
| 5,904,011 | A | 5/1999 | Biro |
| 5,906,082 | A | 5/1999 | Counihan |
| 6,073,409 | A | 6/2000 | Chambers |
| 6,122,873 | A | 9/2000 | Randjelovic |
| 6,164,031 | A | 12/2000 | Counihan |
| 6,170,212 | B1 | 1/2001 | Suchyna et al. |
| 6,363,675 | B1 | 4/2002 | Shelton |
| 6,637,169 | B2 | 10/2003 | Niese et al. |
| 6,883,287 | B2 | 4/2005 | Niese et al. |
| 7,121,052 | B2 | 10/2006 | Niese et al. |
| 7,127,857 | B2 | 10/2006 | Randjelovic |
| 7,181,889 | B2 | 2/2007 | Perkowski et al. |
| 7,185,466 | B2 | 3/2007 | Randjelovic |
| 7,288,310 | B2 | 10/2007 | Hardwick |
| 7,485,358 | B2 | 2/2009 | Benaets |
| 7,703,252 | B2 * | 4/2010 | Randjelovic ..... E04F 15/225 52/177 |
| 2002/0033000 | A1 | 3/2002 | Pantelides et al. |
| 2002/0189184 | A1 | 12/2002 | Shelton |
| 2003/0172608 | A1 | 9/2003 | Chambers |
| 2004/0040242 | A1 | 3/2004 | Randjelovic |
| 2005/0257474 | A1 | 11/2005 | Randjelovic |
| 2006/0096187 | A1 | 5/2006 | Perkowski et al. |
| 2006/0242916 | A1 | 11/2006 | Simko et al. |
| 2008/0104915 | A1 | 5/2008 | Randjelovic |
| 2009/0084054 | A1 | 4/2009 | Randjelovic et al. |
| 2013/0025965 | A1 * | 1/2013 | Miyake ..... E04F 15/225 181/290 |
| 2013/0104479 | A1 | 5/2013 | Thornton |

FOREIGN PATENT DOCUMENTS

| | | | | |
|---|---|---|---|---|
| CN | 2934457 | Y | 8/2007 | |
| DE | 106748 | C | 1/1899 | |
| DE | 3838733 | A1 * | 5/1990 | ..... E04F 15/22 |
| DK | 53863 | C | 11/1937 | |
| EP | 0565082 | A2 | 10/2002 | |
| FI | WO 2004005649 | A1 * | 1/2004 | ..... E04F 15/225 |
| FR | 2740161 | A1 * | 4/1997 | ..... E04F 15/22 |

* cited by examiner

VIBRATION DAMPING FLOOR SYSTEM

PRIORITY CLAIM

This application claims priority to U.S. Provisional Patent Application 62/156,685 filed on May 4, 2015 entitled "Vibration Dampening Floor System" which is incorporated herein by reference in its entirety.

FIELD OF THE TECHNOLOGY

This technology relates generally to flooring. Specifically, it relates to an improved damping and impact absorption system for floors.

BACKGROUND

The dynamic forces caused by sports activities, dance, or other activities may vary significantly, but there are important common features. In many sport activities, the ground contact of the feet is temporarily interrupted, resulting in rhythmical impact forces. Additional forces such as bouncing a ball on the floor also creates a rhythmical impact force. Many dance activities are characterized by the fact that there is continuous ground contact resulting in smaller forces that are comparable with those of brisk walking though some dances may create greater forces more like those of a sporting event. Two problems are caused by these and other impact forces on a flooring surface. First, the repeated impact by the user on a hard floor can cause discomfort or eventual injury. It is desirable to absorb the loads placed on the floor while maintaining the essential characteristics of the flooring surface (e.g., ball-bounce, the ability to jump and otherwise move quickly, etc.). Second, vibrations caused by the rhythmical impact forces negatively affect the performance of the flooring system, can create unwanted acoustical effects, and can also negatively affect the construction of the flooring system itself requiring unnecessary maintenance and/or replacement. It is therefore desirable to have a flooring system that optimizes vibrational damping while also absorbing loads all the while maintaining flooring system performance.

BRIEF DESCRIPTION OF THE FIGURES

To further clarify the above and other aspects of the present technology, a more particular description of the technology will be rendered by reference to specific embodiments thereof which are illustrated in the appended drawings. It is appreciated that these drawings depict only aspects of the technology and are therefore not to be considered limiting of its scope. The drawings are not drawn to scale. The technology will be described and explained with additional specificity and detail through the use of the accompanying drawings in which.

DETAILED DESCRIPTION OF THE ILLUSTRATED EMBODIMENT

Figure 1:
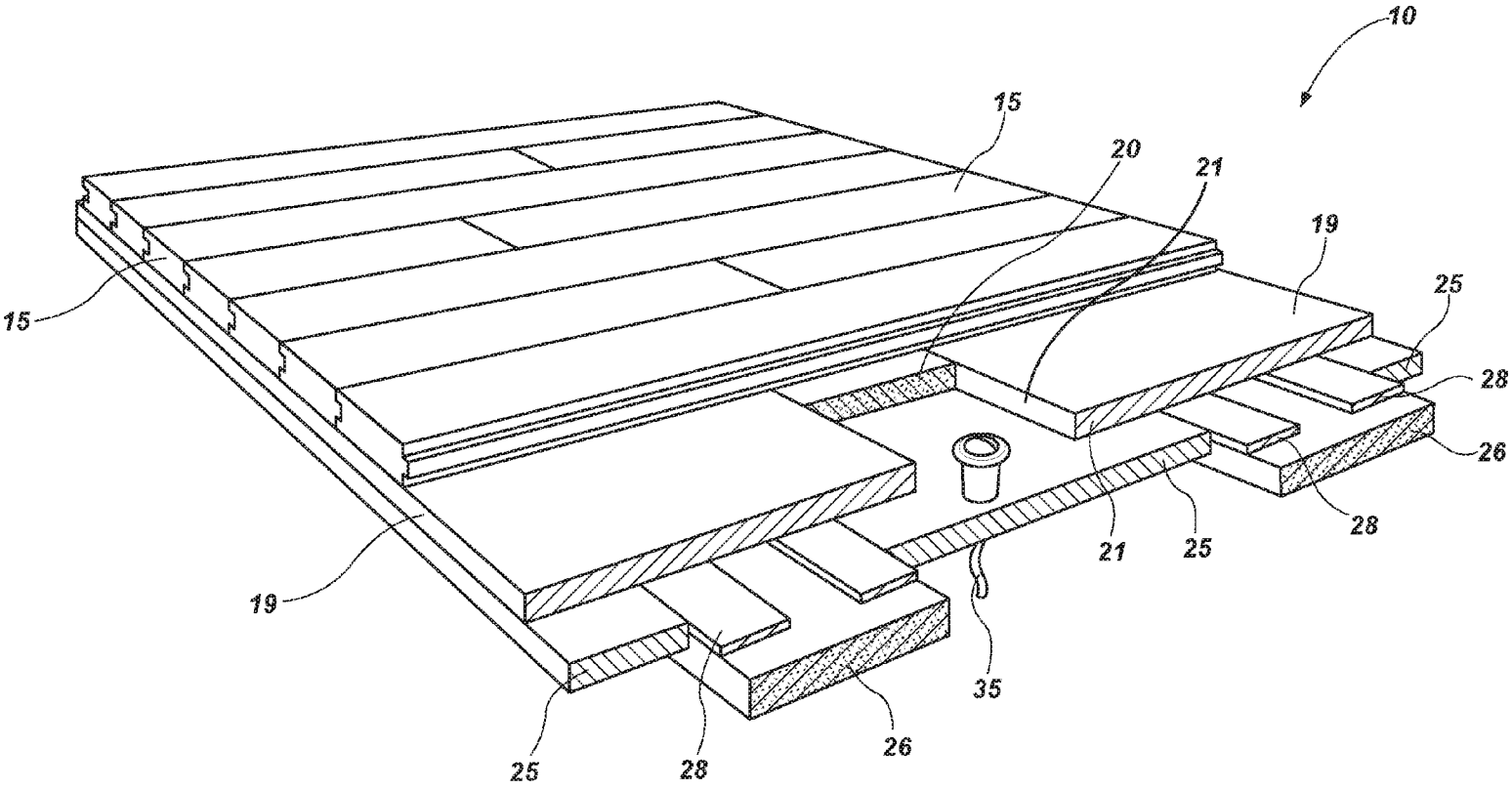
FIG. 1 is a perspective view of a flooring system in accordance with one aspect of the technology.

The following detailed description includes reference to the accompanying drawings, which form a part hereof and in which are shown, by way of illustration, exemplary embodiments. It is believed that the combination of pre-compressed resilient members within a flooring system and other impact absorbing designs will improve the performance of the flooring system. However, before the present technology is disclosed and described, it is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting. Although the following detailed description contains many specifics for the purpose of illustration, a person of ordinary skill in the art will appreciate that many variations and alterations to the following details can be made and are considered to be included herein. Accordingly, the following aspects of the technology are set forth without any loss of generality to, and without imposing limitations upon, any claims set forth. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a line" includes a plurality of such lines. In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," in this specification it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in any manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 1.5, 2, 2.8, 3, 3.1, 4, 4.6, and 5, individually. This same principle applies to ranges reciting only one numerical value as a minimum or a maximum. Furthermore, such an interpretation should apply regardless of the breadth of the range or the characteristics being described.

As used herein, "enhanced," "improved," "performance-enhanced," "upgraded," "improvement," and the like, when used in connection with the description of a device, component, or process, refers to a characteristic of the device, component or process that provides measurably better form, function, or outcome as compared to previously known devices or processes. This applies both to the form and function of individual components in a device or process, as well as to such devices or processes as a whole. Reference throughout this specification to "an example" means that a particular feature, structure, or characteristic described in connection with the example is included in at least one embodiment. Thus, appearances of the phrase "in an example" in various places throughout this specification are not necessarily all referring to the same embodiment.

It should be understood that the aspects of the technology discussed herein are contemplated for use with any type of flooring system. For purposes of illustrating the various aspects of the methods and systems claimed herein, the discussion below will be primarily directed to describing exemplary embodiments directed to sports floors. It should be noted, however, that the elements and principles discussed herein are applicable to other applications. It is also noted that discussion of methods and systems herein can be interchangeable with respect to specific aspects. In other words, specific discussion of one method or system (or components thereof) herein is equally applicable to other aspects as they relate to the system or method, and vice versa.

An initial overview of technology embodiments is provided below and specific technology embodiments are then described in further detail. This initial summary is intended to aid readers in understanding the technology more quickly, but is not intended to identify key or essential technological features, nor is it intended to limit the scope of the claimed subject matter. The present technology in its various embodiments, some of which are depicted in the figures herein, can be broadly described as a vibration damping and shock absorption flooring system. The system comprises a lower resilient pad material resting between the underside of dimensioned sections (also referred to as force transfer members) and a surface of a supporting substrate such as concrete, for example. The dimensioned sections may vary in width and height as suits a particular application and as suits a particular design of the lower resilient pad. That is, various combinations of different geometries of the dimensioned sections may be employed depending on the height, density, and/or resilience of the lower resilient pad and the desired response to a load disposed on the contact surface as explained in more detail herein. The lower resilient pad and dimensioned sections are disposed in a space between a lower subfloor. An upper subfloor is disposed above the dimensioned sections and is spaced to permit the placement of an upper resilient pad between upper subfloor sections. A contact flooring surface is disposed atop the upper subfloor.

In one aspect of the technology, the system operates to transfer force from the contact flooring surface (e.g., an athlete jumping on the floor and/or vibrations from bouncing a ball) to the lower resilient pad by way of the dimensioned section. Depending on the density/resilience of the bottom pad, a thinner dimensioned section would be "absorbed" more by the upper portion of the bottom resilient pad resulting in less overall compression of the entire bottom pad. In this manner the degree to which the entire bottom pad is compressed (resulting in contact between the bottom subfloor section and the ground) is regulated. In contrast, a wider dimensioned section engages a greater surface area of the upper portion of the lower pad and is more likely to increase compression of the entire bottom pad as the upper subfloor pushes down on the dimensioned section. This results in less force being "absorbed" by the upper portion of the lower pad and more of the overall pad being compressed in response to forces acting on the upper subfloor. Advantageously, lighter weight and/or vibrational forces disposed on the playing surface is absorbed by the upper portion of the lower pad without compression of the entire pad. The "absorption" or compression of the lower pad has at least two effects. First the absorption of the top portion of the lower pad helps absorb shock (e.g., non-harmonic motion) from a user jumping or otherwise creating a force, such as a vertical force, on the top of the upper contact surface. The compression of the lower pad about the force transfer member assists in isolating vibration (e.g., harmonic motion) acting on the floor as a result of bouncing a ball or other vibration inducing activities.

In some cases, a significant amount of weight may be placed on the upper playing surface (e.g., heavy machinery). Because the gap between the lower subfloor and the ground is significantly less than the total thickness of the lower pad, the lower subfloor will come into contact with the ground surface before the lower pad suffers from over compression which can result in ultimate failure of the pad. This preserves the pads ability to absorb lighter loads and dampen vibrations during regular use of the floor while preserving the overall usefulness of the flooring during a heavy load event.

The upper pad is sized to fit tightly in the space between the upper subfloor and has a profile height that is larger than the profile height of the upper subfloor. When the playing surface (e.g., a hardwood basketball floor, etc.) is disposed on top of the upper subfloor, the upper pad is compressed both on the top by the playing surface and on the sides as the pad's propensity to "bulge" in a lateral direction in response to a top load is limited by the side walls of the upper subfloor. In this manner, the pad is under a constant state of compression which results in a damping of vibration resulting from impact on the playing surface and/or the transfer of force between the playing surface to the upper and lower subfloors. In like manner, in one aspect of the technology, the force transfer members may be arranged such that in an unbiased state they compress a portion of the upper portion of the lower pad. In this state of partial compression, vibrations that are induced in the flooring system are dampened. In this instance, the term "unbiased state" refers to the state of the floor without a top load being placed on the floor itself. The partial compression of the upper portion of the lower pad may be the result of the weight of the upper subfloor and upper contact surface itself acting on the force transfer members. Alternatively, during assembly of the floor, the relative height of the force transfer member with respect to the height of the lower pad and the height of the void result in partial compression of the pad. In other words, the height of the force transfer member is greater than any space between the top of the lower pad and the bottom of the upper subfloor.

Figure 2:
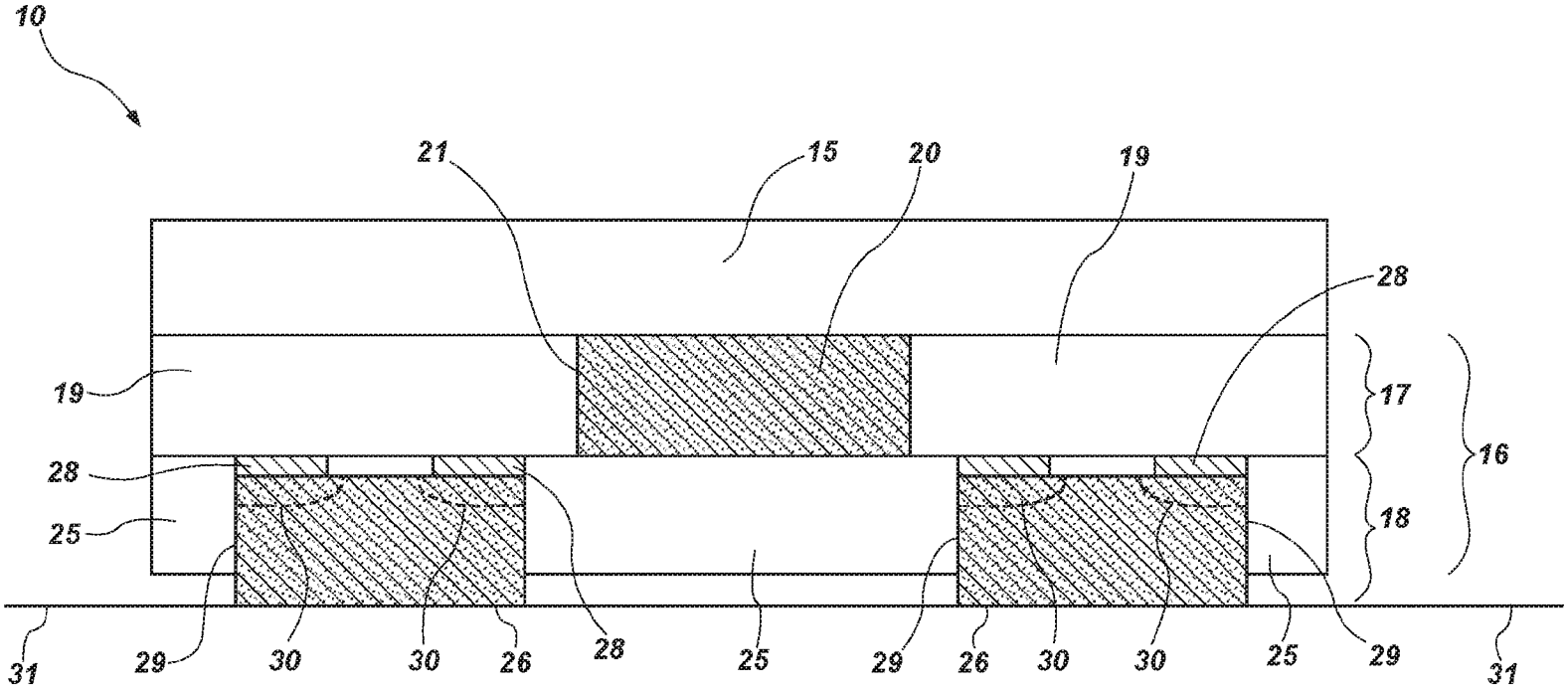
FIG. 2 is a side view of a flooring system in accordance with one aspect of the technology.

With specific reference now to the figures, FIGS. 1 and 2 disclose a flooring system 10 comprising an upper contact surface 15 disposed over a subfloor assembly 16 in accordance with one aspect of the technology. In one aspect of the technology, the upper contact surface 15 comprises a tongue-and-groove hardwood flooring assembly used in conventional athletic applications. However, the upper contact surface 15 may comprise various types of solid surfaces used as a contact flooring surface (i.e., the upper most surface of a floor that is in contact with foot and/or other traffic) including polymeric materials, metal materials, or other materials used to manufacture an upper contact flooring surface. The subfloor assembly 16 comprises an upper subfloor section 17 and a lower subfloor section 18. The upper subfloor section 17 comprises a plurality of upper subfloor members 19 spaced apart from one another to create an opening or void to permit the placement of a resilient upper pad member 20 between adjacent upper subfloor members 19. In one aspect of the technology, the upper subfloor members 19 have a profile height that is less than the profile height of the resilient upper pad 20, when the resilient upper pad 20 is in an unbiased state (i.e., no load is placed on the top of the pad). For example, in one aspect of the technology the upper subfloor members 19 comprise a ½ inch thick plywood member that is eight inches wide and eight feet long. When the resilient upper pad 20 is in an unbiased (i.e., not compressed) state, it comprises a ⅝ inch to 9/16 inch height of open-cell polyurethane (bonded or unbonded) that is four inches wide and eight feet long. When placed in the flooring system 10, the resilient upper pad 20 is compressed to a ½ inch height substantially equal to the height of the adjacent upper subfloor members 19. Advantageously, the compressed resilient upper pad 20 provides a small amount of pressure against the upper contact surface 15, against side walls 21 of upper members 19, and against the top of the lower subfloor 25 resulting in a damping effect from vibrations occurring as a result of top loads placed on the upper contact surface 15 or otherwise acting on the interface between the upper contact surface 15 and the upper subfloor members 19 as well as other vibrations acting on other members of the floor.

In accordance with one aspect of the technology, the upper subfloor members 19 are secured to lower subfloor members 25. They may be secured together by way of a mechanical fastener such as screws, nails, staples, etc. or chemically secured by way of an adhesive, a combination of mechanical or chemical means, or other means. The lower subfloor assembly 18 comprises a plurality of lower subfloor members 25 spaced apart to permit placement of a resilient lower pad 26 within the space between sidewalls 29 of the lower subfloor members 25. At least one force transfer member 28 is disposed above the resilient lower pad 26 between the top of the resilient lower pad 26 and the bottom of the upper subfloor member 19. The force transfer member 28 acts to transfer a top load disposed about the upper contact surface 15 to discrete upper portions 30 of the resilient lower pad 26. In this manner, smaller loads that are placed on the upper contact surface 15 may be absorbed by compression of a discrete area 30 of the resilient lower pad 26 about the force transfer member 28 rather than the entire surface of the resilient lower pad 26. In this aspect, while much of the compression of the resilient lower pad 26 occurs about the discrete area 30, it is understood that some compression may occur in the other portions of the resilient lower pad 26. In one aspect, a primary amount of the compression occurs in the discrete area 30 adjacent the force transfer member 28 and, in one aspect, is sized from approximately 1 to 1.5 times the height of the force transfer member 28. As the top loads increase, however, the entire resilient lower pad 26 may be compressed to absorb the load. In accordance with one aspect, if the top load exceeds a threshold level, the resilient lower pad 26 is compressed to such a degree that a bottom portion of the lower subfloor comes into contact with the ground surface 31 effectively "bottoming out" the floor. Put another way, the floor has a first position where the resilient lower pad 26 is in an uncompressed state and elevates the floor a distance above a ground surface 31 upon which the floor is disposed and in a second position wherein the resilient lower pad 26 is compressed downward and the bottom of the lower subfloor 25 is in contact with the ground surface 31. The floor has a third position (intermediate the first and second positions) where the force transfer elements 28 are pressed downward into a top portion of the resilient lower pad 26 but the bottom of the lower subfloor 25 does not contact the ground 31.

While specific reference is made herein with respect to a compressive force being communicated to the resilient lower pad 26 by way of the force transfer member 28 after a top load has been placed thereon, it is understood that in one aspect of the technology, the floor may be constructed such that the force transfer member 28 compresses an upper portion of the resilient lower pad 26 with no upper load begin placed on top of the floor. In one aspect, the combined weight of the upper contact surface 15 and the upper subfloor 19 "pre-compresses" the force transfer member 28 into the resilient lower pad 26 enhancing the vibrational damping capacity of the resilient lower pad 26. In another aspect, the height of the force transfer member 28 is greater than the opening between the top of the resilient lower pad 26 and the bottom of the upper subfloor 29. As such, even without the weight of the upper subfloor 19 and upper contact surface 15, once constructed, the force transfer member 28 compresses a portion of the resilient lower pad 26.

In one aspect of the technology, the lower subfloor members 25 comprise ½ inch thick plywood cut in eight inch wide by eight foot long planks spaced apart to create a void or opening between planks that is approximately four inches wide and eight feet long. The resilient lower pad 26 is ¾ inch thick, four inches wide, and eight foot long. The force transfer member 28 comprises a 1¼ inch wide by ⅛ inch thick piece of wood that is one foot long. In this example, a ⅜ inch gap 30 is located beneath the lower subfloor member 25 and the ground surface 31. While two force transfer members 28 are shown in FIGS. 1 and 2, each one abutting a side wall of the void or opening, numerous other variations of a force transfer member and other elements of the flooring system 10 shown herein are contemplated. For example, a single force transfer member 28 may be used and may be wider or less than 1¼ inch wide and may be greater than or less than ⅛ thick as suits a particular design. The transfer members 28 may also be longer or shorter than one foot as suits a particular design. Additionally, the transfer members 28 may be made of a material other than wood (e.g., a rigid or semi-rigid polymer, plastic, metal alloy, rubber, or other material). A plurality of three force transfer members 28 that are each ¾ inch wide and ⅛ inch thick may be used also. As such, numerous different combinations may be employed depending on the desired impact on the discrete area 30 of the resilient lower pad 26. This is a function of the height of the resilient lower pad 26 as well as its overall resiliency and the loads that are expected to be placed on the flooring system 10.

In accordance with one aspect of the technology, the upper and lower resilient pads 20, 26 comprise re-bonded foam, open cell polyurethane, closed-cell polyethylene, or other material as desired. The upper and lower resilient pads 20, 26 may be made of the same material or they may be different. They may have a similar density or they may have different densities. For example, in one aspect of the technology, the upper resilient pad 20 comprises an open-cell polyurethane having a density ranging from seven to nine pounds and the lower resilient pad comprises a closed-cell polyethylene having a density ranging from five to seven pounds. In this example, the lower resilient pad 26 has a greater sensitivity (and hence a greater reaction) to vertical loads placed thereon. The upper resilient pad 20 with the greater has greater sensitivity to and greater vibrational absorption capacity. However, the upper resilient pad 20 may be constructed of a lower density material than that used for the lower resilient pad 26 as suits a particular purpose. As noted herein, the force transfer members 28 may be rigid and may comprise a material such as wood, metal, or a polymer or they may comprise a resilient material such as rubber. Particularly, they may comprise a compliant material having a hardness (e.g., ranging between 20A Shore and 60A Shore) greater than the hardness of the upper and lower resilient pads 20, 26.

In accordance with one aspect of the technology, the upper and lower subfloor members 19 and 25, respectively, are disposed in a staggered position such that, on average, two inches of a lateral side of an upper subfloor member 19 is placed on top of a lateral side of a lower subfloor member 25. In addition, approximately two inches of top and bottom sides of the upper subfloor member 19 is located on top of the top and bottom sides of the lower subfloor member 25. In this manner, the vibrations that are not dampened by the first resilient pad 20 but are instead communicated through the flooring system to the lower subfloor transfer member 28 are absorbed by the second lower resilient pad 26. Moreover, the widths of the respective voids or openings that house the respective resilient pads may be different in order to accommodate different sized pads as suits a particular purpose. In one aspect of the technology, an anchoring pin 35 is inserted through the lower subfloor member 25 and secured into the ground. An insulating rubber collar is used to prevent contact between the lower subfloor member 25 and the anchoring pin 35. The head of the anchoring pin 35 rests on a top surface of the lower subfloor member 25.

In accordance with one aspect of the technology, with reference generally to FIGS. 3-7, a floor or flooring system is disclosed having an upper contact surface 15 and an upper subfloor 19 and lower subfloor 25. An opening or void in each of the subfloors respective subfloor members and is configured to accommodate a resilient pad therein. The upper resilient pad 20, in an unbiased state, has a height that is greater than the sidewalls 21 of the upper subfloor element 19 such that when the upper contact surface 15 is placed on top of the upper subfloor 19 and the resilient pad 20, the upper resilient pad is in a compressed or biased state. In the compressed or biased state, the upper resilient pad 20 creates an upward force on the upper contact surface 15, lateral forces acting on sidewalls 21, and a downward force acting on the top of the lower subfloor 25. The lower resilient pad 26 is sized and placed within the void or opening in the lower subfloor in such a way as to leave an open top portion 33 of the void or opening where the force transfer members reside.

Figure 3:
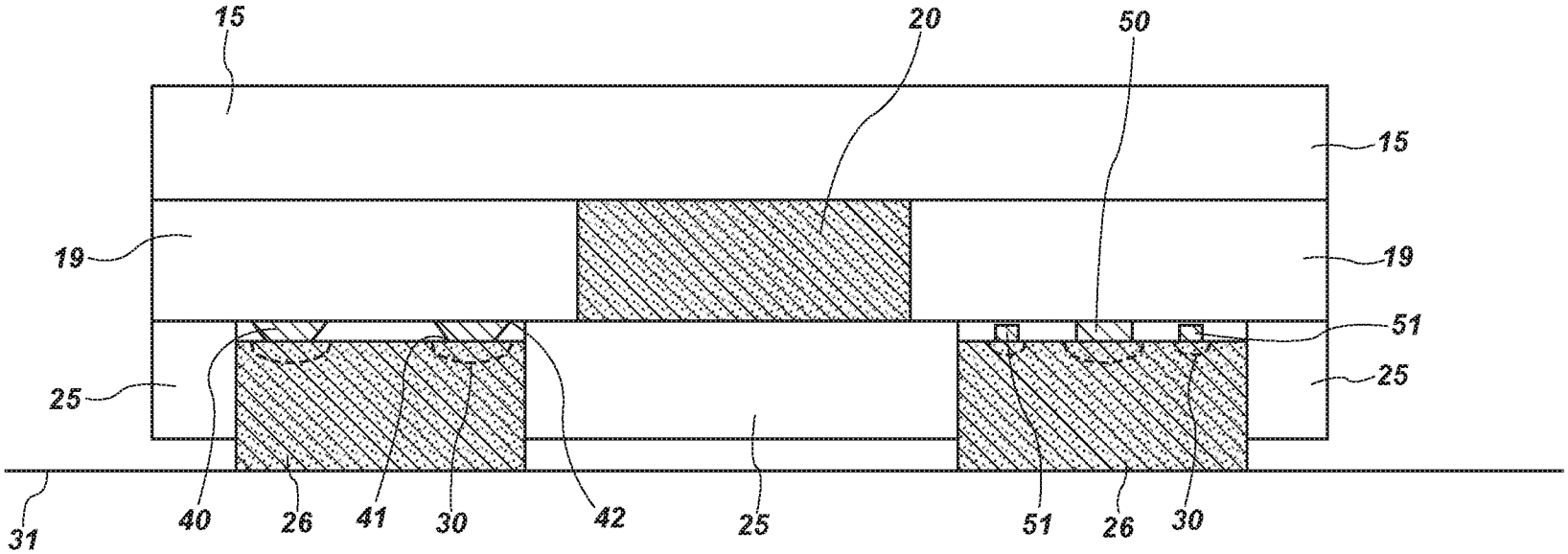
FIG. 3 is a side view of a flooring system in accordance with one aspect of the technology.
Figure 4:
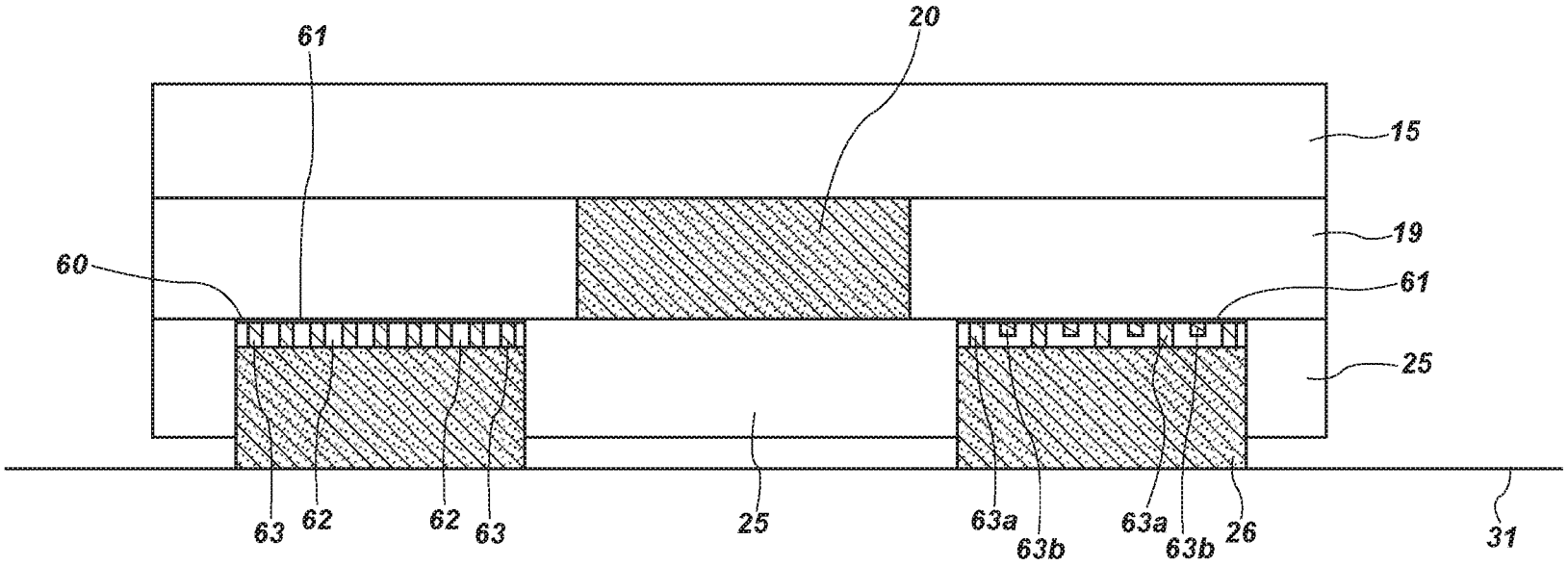
FIG. 4 is a side view of a flooring system in accordance with one aspect of the technology.

In accordance with one aspect of the technology, with reference to FIG. 3, the force transfer members 40 are shaped to approximate a trapezium having a narrow bottom portion 41 and a wide top portion 42. The force transfer members 40 may be post-like trapezium members or they may comprise a long strip of material having a cross-section in the shape of a trapezium. In another aspect of the technology, the force transfer members 50 may have different heights within the same portion 33 of the void or opening. In one example, a first transfer member 50 has a height that is substantially equivalent to the height of open portion 33 of the void. Second and third transfer members 51 have a height that is less than the height of the first transfer member 50. In this manner, the floor is more sensitive to smaller forces acting in a vertical direction on the floor such that smaller loads are absorbed more easily due to the single force transfer member 50 acting on the lower resilient pad 26. When a force is great enough to cause the force transfer member 50 to compress downward such that the bottom 19*a* of upper subfloor 19 comes into contact with the force transfer members 51, the additional force transfer member 51 distribute additional load to other portions of the lower resilient pad 26. This results in a multi-staged load absorption mechanism. With reference to FIG. 4, the force transfer element may comprise an insert 60 disposed longitudinally within the void. The insert 60 comprises a base 61 with a plurality of alternating channels 62 and ridges 63 that extend from the base to contact the lower resilient pad 26. In one aspect, the ridges 63 may comprise different heights as seen in 63*a* and 63*b*. While FIG. 4 discloses a base 61 with downward facing channels 62 and ridges 63, the insert may comprise a plurality of alternating posts instead of ridges. Those posts may also be of different heights to create the multi-stage impact absorption mechanism discussed above with respect to FIG. 3.

Figure 5:
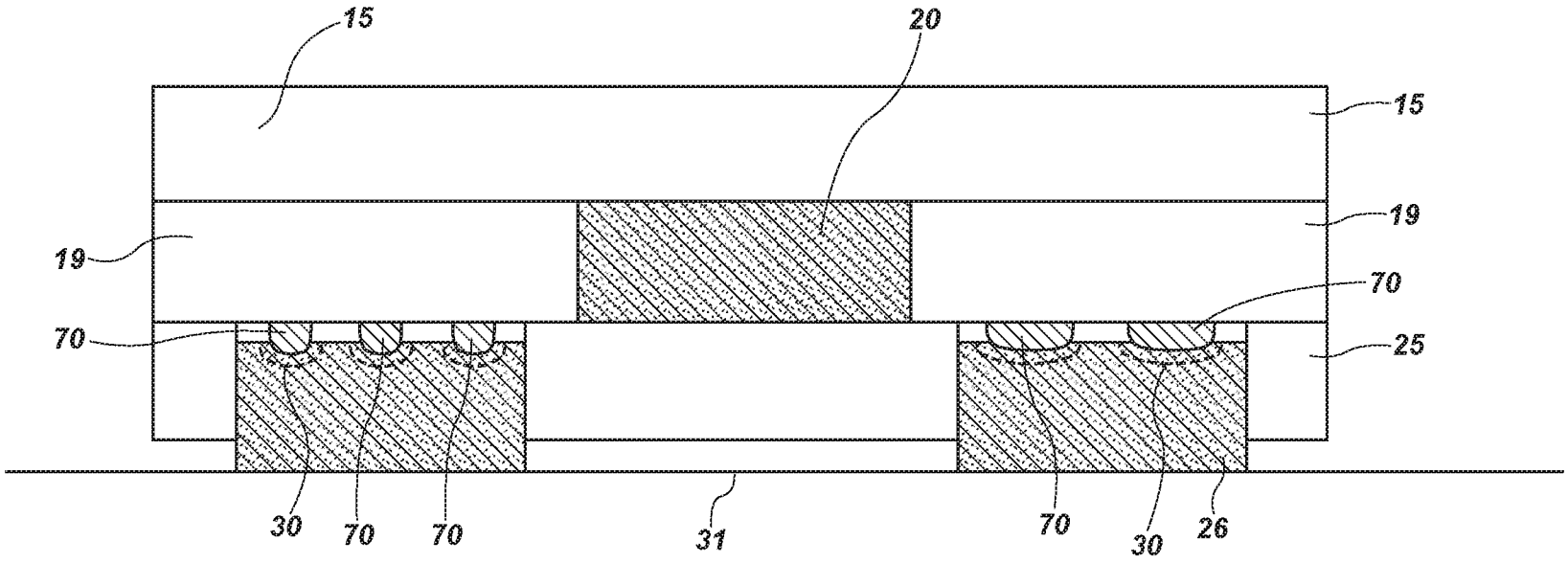
FIG. 5 is a side view of a flooring system in accordance with one aspect of the technology.
Figure 6:
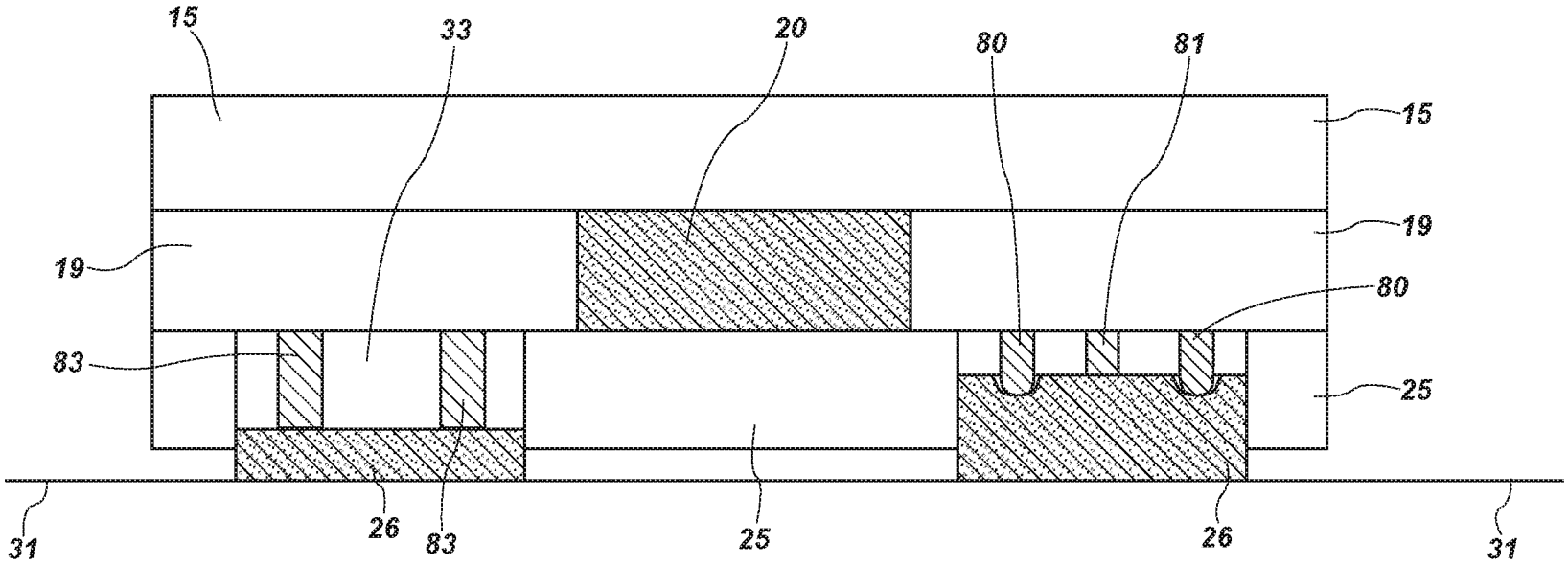
FIG. 6 is a side view of a flooring system in accordance with one aspect of the technology.
Figure 7:
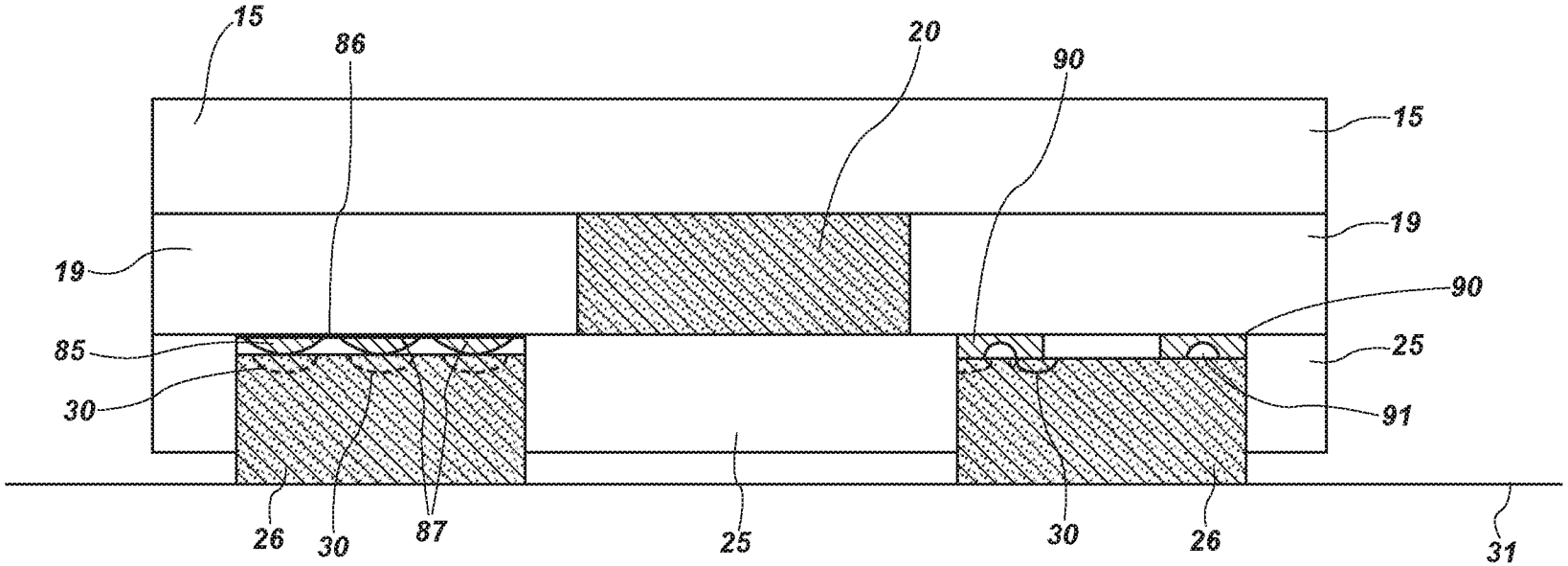
FIG. 7 is a side view of a flooring system in accordance with one aspect of the technology.

With reference now to FIG. 5, force transfer member 70 may have an arcuate or rounded tip and may be pre-disposed in a compressive state or "pre-compressed" arrangement whereby an upper portion of the lower resilient pad 26 is compressed before any top load (jumping, dancing, bouncing a ball, or otherwise) is placed on the top of the upper contact surface 15. In this manner, the lower resilient pad 26 is configured to absorb vibrational forces as well as vertical forces acting on the floor. While it is in a pre-compressed state, the force transfer members 70 can still move vertically downward and cause further compression of the lower resilient pad 26 when a top load is placed on the floor. FIG. 6 discloses an arrangement where two force transfer members 80 are in a "pre-compressed" arrangement and a third force transfer element 81 is not in a pre-compressed state. In another aspect of the technology, the force transfer elements 83 occupy a substantial amount of the vertical height of the opening 33 or void between lower subfloor 25 members. Numerous arrangements and designs related to the force transfer element are contemplated herein. For example, FIG. 7 discloses, in accordance with one aspect, an element 85 having a base 86 and a plurality of arcuate ridges 87 extending laterally across the surface of the base 86. Alternatively, in accordance with an addition aspect, a force transfer member 90 comprises a block-shape having an opening 91 in the center of the block configured to receive a portion of the lower resilient pad 26 therein as the force transfer member 90 is pushed downward into the lower resilient pad 26 from a vertical top load acting thereon.

Aspects of the technology are useable in a method of damping vibrations and absorbing loads in a floor. The method comprises placing a load on a top surface of a floor, said floor comprising an upper contact surface disposed atop an upper subfloor, the upper subfloor comprising a first resilient pad disposed within an opening of the upper subfloor and beneath the upper contact surface, wherein the first resilient pad is in a compressed state, and is in contact with and generating a force against, (a) the upper contact surface, (b) the upper subfloor, and (c) the lower subfloor. The floor also comprises a lower subfloor disposed beneath and in contact with the upper subfloor, the lower subfloor comprising a second resilient pad disposed within an opening of the lower subfloor and beneath the upper subfloor, wherein the second resilient pad elevates the bottom of the lower subfloor a distance above a ground surface on which the floor is located. A force transfer member is disposed above the second resilient pad and is configured to compress an upper portion of the second resilient pad. The method further comprises absorbing vibrational forces acting on the first resilient pad that are communicated to the first pad through the upper contact surface, the upper subfloor, or the lower subfloor and absorbing forces acting on the second resilient pad that are communicated to the second pad through the force transfer member and the lower subfloor. In addition, the method comprises compressing a portion of the second resilient pad thereby absorbing a top load acting on the floor and further compressing the second resilient pad until the bottom of the lower subfloor contacts the ground.

The foregoing detailed description describes the technology with reference to specific exemplary embodiments. However, it will be appreciated that various modifications and changes can be made without departing from the scope of the present disclosure as set forth in the appended claims. The detailed description and accompanying drawings are to be regarded as merely illustrative, rather than as restrictive, and all such modifications or changes, if any, are intended to fall within the scope of the present disclosure as described and set forth herein.

More specifically, while illustrative exemplary invention embodiments have been described herein, the disclosure is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the disclosure should be determined solely by the appended claims and their legal equivalents, rather than by the descriptions and examples given above.

The invention claimed is:

1. A floor comprising:

an upper contact surface disposed atop an upper subfloor, the upper subfloor comprising a void having a height that is defined by opposing sidewalls of the upper subfloor, a top that is defined by a bottom surface of the upper contact surface, a bottom that is defined by a top surface of a lower subfloor, a width, and a length;

a first resilient pad disposed under compression within the void of the upper subfloor;

wherein the lower subfloor is disposed beneath and in contact with the upper subfloor, the lower subfloor comprising a void that is laterally offset from the void of the upper subfloor;

a second resilient pad disposed within the void of the lower subfloor;

a plurality of removable force transfer members disposed within the void of the lower subfloor and above the second resilient pad.

2. The floor of claim 1, wherein in an unbiased state, the first resilient pad has a height which is greater than the height of the sidewalls of the first subfloor.

3. The floor of claim 2, wherein when the first resilient pad is under compression, the lateral sides of the first resilient pad generate a lateral force against the sidewalls of the first subfloor.

4. The floor of claim 2, wherein in a first position the second resilient pad is in an uncompressed state and elevates the lower subfloor a distance above a ground surface upon which the floor is disposed and in a second position the second resilient pad is compressed downward and the bottom of the lower subfloor is in contact with the ground surface.

5. The floor of claim 4, wherein in a third position, the force transfer members are pressed downward into a top portion of the second resilient pad, the second resilient pad elevating the lower subfloor a distance above the ground surface.

6. The floor of claim 5, wherein the floor is in the first position in an unbiased state and the floor is in the third position when a first force is placed on a top surface of the floor and in a second position when a second force is placed on a top portion of the floor, wherein the second force is greater than the first force.

7. The floor of claim 5, wherein the floor is in the third position in an unbiased state and the floor is in the second position when a first force is placed on a top surface of the floor that exceeds a predetermined threshold.

8. The floor of claim 5, wherein an upper portion of the second resilient pad is compressed in an area adjacent the force transfer members.

9. The floor of claim 8, wherein an area of compression of the second resilient pad adjacent the force transfer members is 1 to 1.5 the height of the force transfer member.

10. The floor of claim 1, wherein the floor comprises two force transfer members each abutting an opposing sidewall of the void in the lower subfloor.

11. The floor of claim 1, wherein the force transfer member comprises an arcuate tip.

12. The floor of claim 1, wherein the force transfer member approximates the shape of a trapezium.

13. The floor of claim 1, further comprising a plurality of force transfer members disposed above the second resilient pad and beneath the upper subfloor.

14. The floor of claim 13, wherein the resilient lower pad are disposed within a bottom portion of the void and the plurality of force transfer members are disposed within a top portion of the void, the top portion of the void having a height.

15. The floor of claim 14, wherein at least one of the force transfer members comprises a height that is equivalent to the height of the top portion of the void and at least one other of the force transfer members comprises a height that is less than the height of the top portion of the void.

16. The floor of claim 1, wherein the force transfer members comprise an insert having a plurality of downward facing posts, the downward facing posts having a plurality of heights.

17. The floor of claim 1, wherein the force transfer members comprise an insert having a plurality of upward facing posts, the plurality of posts having a plurality of heights.

18. The floor of claim 1, wherein the force transfer members comprise an insert having a plurality of channels, the plurality of channels having a plurality of depths.

19. The floor of claim 1, wherein the force transfer member comprises a rectangular strip having a width that is at least one third the width of the void.

20. The floor of claim 1, wherein the first resilient pad comprises a material having a first density and the second resilient pad comprises a material having a second density, the first density being greater than the second density.

21. The floor of claim 1, wherein the width of the void within the upper subfloor is greater than the width of the void within the lower subfloor.

22. The floor of claim 1, wherein the combined height of the force transfer members and the second resilient pad is greater than the height of the sidewall of the lower subfloor.

23. The floor of claim 1, wherein the force transfer members comprise a rigid material.

24. The floor of claim 1, wherein the force transfer members comprise a resilient material.

25. The floor of claim 24, wherein the force transfer members comprise a material having a density and hardness greater than a density and hardness of the second resilient pad.

26. A flooring system for damping vibrations and absorbing vertical loads placed therein, comprising: an upper contact surface disposed atop an upper subfloor, the upper subfloor comprising a first resilient pad disposed within an opening of the upper subfloor and beneath the upper contact surface, wherein the first resilient pad is in a compressed state generating (i) an upward force against the upper contact surface and (ii) a lateral force against the upper subfloor; a lower subfloor disposed beneath and in contact with the upper subfloor, the lower subfloor comprising a second resilient pad disposed within an opening of the lower subfloor and beneath the upper subfloor; at least one force transfer member disposed within a space between the second resilient pad and a bottom of the upper subfloor, the force transfer member compressing an upper portion of the second resilient pad.

27. The flooring system of claim 26, wherein the first resilient pad comprises a first density and the second resilient pad comprises a second density, the first density being different than the second density.

28. The flooring system of claim 27, wherein the density of the second pad is less than the density of the first pad.

29. The flooring system of claim 1, wherein the force transfer member comprises a resilient member having a hardness that is greater than a hardness of the second pad.

30. The flooring system of claim 1, wherein the force transfer member comprises a rigid material.

31. The flooring system of claim 1, wherein the force transfer member comprises a triangular shape.

32. A method of damping vibrations and absorbing loads in a floor, comprising:

(i) placing a load on a top surface of a floor, said floor comprising:

an upper contact surface disposed atop an upper subfloor, the upper subfloor comprising a first resilient pad disposed within an opening of the upper subfloor and beneath the upper contact surface, wherein the first resilient pad is in a compressed state, and is in contact with and generating a force against, (a) the upper contact surface, (b) the upper subfloor, and (c) the lower subfloor;

a lower subfloor disposed beneath and in contact with the upper subfloor, the lower subfloor comprising a second resilient pad disposed within an opening of the lower subfloor and beneath the upper subfloor, wherein the second resilient pad elevates the bottom of the lower subfloor a distance above a ground surface on which the floor is located;

a force transfer member disposed above the second resilient pad, the force transfer configured to compress an upper portion of the second resilient pad;

(ii) absorbing vibrational forces acting on the first resilient pad that are communicated to the first pad through the upper contact surface, the upper subfloor, or the lower subfloor and absorbing forces acting on the second resilient pad that are communicated to the second pad through the force transfer member and the lower subfloor;

(iii) compressing a portion of the second resilient pad thereby absorbing a top load acting on the floor.

33. The method of claim 32, further comprising compressing the second resilient pad until the bottom of the lower subfloor contacts the ground.

* * * * *